United States Patent [19]

Evans

[11] 4,445,748

[45] May 1, 1984

[54] MASS TERMINATION OF DENSELY GROUPED CONDUCTORS

[75] Inventor: William R. Evans, Clemons, N.C.

[73] Assignee: AMP Incorporated, Harrisburg, Pa.

[21] Appl. No.: 136,852

[22] Filed: Apr. 3, 1980

[51] Int. Cl.[3] ..... H01R 4/24

[52] U.S. Cl. ..... 339/94 M; 337/98

[58] Field of Search ..... 339/96–99, 339/260, 94 M

[56] References Cited

U.S. PATENT DOCUMENTS

| | | | |
|---|---|---|---|
| Re. 26994 | 12/1970 | Fuller et al. | 174/84 |
| 3,879,099 | 4/1975 | Shaffer | 339/99 R |
| 3,932,018 | 1/1976 | Parsons et al. | 339/99 R |
| 3,985,416 | 10/1976 | Dola et al. | 339/98 |
| 4,010,996 | 3/1977 | Hopkins | 339/47 R |
| 4,075,758 | 2/1978 | Parsons et al. | 29/628 |
| 4,114,975 | 9/1978 | Weidler | 339/176 M |
| 4,130,331 | 12/1978 | Neff et al. | 339/97 R |
| 4,153,326 | 5/1979 | Frantz et al. | 339/99 R |

*Primary Examiner*—Eugene F. Desmond

*Attorney, Agent, or Firm*—Gerald K. Kita

[57] ABSTRACT

An electrical connector is disclosed for terminating one or more electrical conductors. The conductors are placed on a holder which moves the conductors lengthwise into cavities of the connector in which electrical terminals are contained. Conductor terminating portions of the terminals are engaged by the holder and are forcefully connected with the conductors.

7 Claims, 12 Drawing Figures

MASS TERMINATION OF DENSELY GROUPED CONDUCTORS

FIELD OF THE INVENTION

The present invention relates to an electrical connector, with particular emphasis being placed upon mass termination of densely spaced, plural conductors in an electrical connector which can be sealed.

BACKGROUND OF THE PRIOR ART

For the purpose of this disclosure, the term "mass termination" means the simultaneous electrical connection of multiple electrical terminals with respective electrical conductors. In each of U.S. Pat. Nos. 4,010,996; 4,075,758 and 4,153,326 mass termination is accomplished by displacing plural conductors laterally of their lengths into and along narrow slots provided in respective electrical terminals. The sides of the slots form resilient jaws which grip the conductors and establish the desired electrical connections. The terminals remain stationary during mass termination, except that some resilient deformation of the terminals occur in response to forceable connection with the conductors.

Each of U.S. Pat. Nos. 4,130,331 and Re. 26,994 discloses an electrical terminal having a resilient blade. A conductor becomes wedged under the blade upon thrusting the conductor lengthwise under the blade.

Each of U.S. Pat. Nos. 3,879,099 and 3,932,018 discloses a connector in which plural conductors are aligned with resilient jaws of respective terminals. Initially the length of each terminal is bent in a V-shape. The V-shape is straightened by bending to force the terminal into compressed connection with a conductor. The terminals must be accessible from a direction transverse to their axes to straighten the same. Therefore the terminals can not be densely grouped.

SUMMARY OF THE INVENTION

An electrical terminal is provided with insulation slicing, conductor gripping jaws provided by opposite sides of a slot defined in a flat plate portion of the terminal. Such a terminal is mounted in each restricted width cavity of an electrical connector housing, with the plate portion projecting in a direction diagonally across the cavity. A web for sealing the connector is incorporated with a conductor holder which is preassembled on the housing. A plurality of conductors are passed through the web and are laid against channel supports which project from the holder toward the terminal plate portions. The holder then is displaced toward the housing to insert the conductors under the diagonally projecting plate portions, the jaws of which initially straddle respective conductors. The holder then engages and pivots the plate portions, from their diagonal orientations, forceably against the straddled conductors, and then into orientations transversely of the conductors. Thereby the jaws become wedged by toggle action of the plate portions, into straddled gripped connection with the conductors. Any insulation present on any conductor is sliced through by the jaws and then scraped aside by the pivoting action of the respective plate. The angular direction of pivoting follows the direction of conductor insertion, and thereby assists rather than impedes conductor insertion. The connection procedure involves a limited number of motions and operations, and thereby is suited for automation. Since the toggle action is confined within the restricted width cavities, and since no transverse motion of the conductors is required, the conductors may be densely spaced in the connector.

OBJECTS

An object of the present invention is to provide a method for mass termination of electrical conductors by use of an electrical connector provided with a conductor holder, which inserts one or more conductors under wire terminating portions of electrical terminals mounted in a housing, and then which pivots the wire terminating portions in the same direction of wire insertion, forceably against the conductors to establish electrical connections therewith.

Another object is to provide a method for mass termination of electrical connectors on dense spacing by use of a connector having a conductor holder which inserts one or more conductors lengthwise into restricted width cavities of the connector, and which activates toggle action electrical terminals within the cavities into wedged electrical connection with the conductors, without generating forces opposing conductor insertion.

Another object of the present invention is to provide an electrical terminal in a restricted width cavity which pivots in a toggle action to connect electrically with a conductor inserted axially of its length along the restricted width cavity.

Other objects and advantages of the present invention will become apparent from the following detailed description taken in conjunction with the drawings.

DETAILED DESCRIPTION

Figure 4:
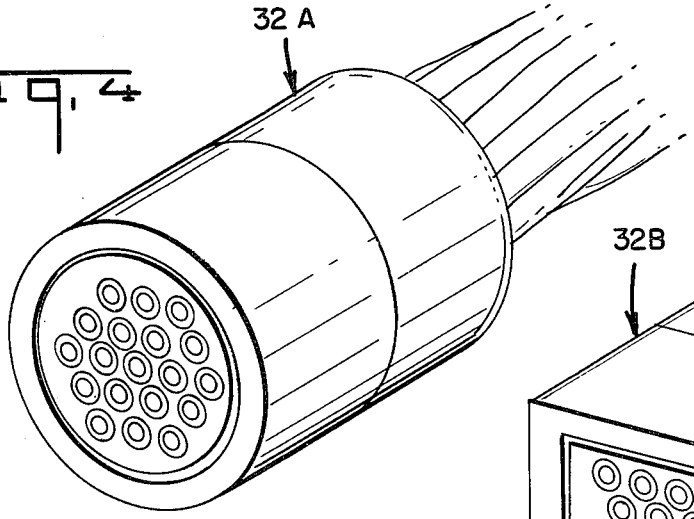
FIG. 4 is an enlarged fragmentary perspective of a cylindrical electrical connector containing densely spaced electrical terminals, according to the present invention, and which are suitable for mass termination according to the disclosed method of the present invention.
Figure 5:
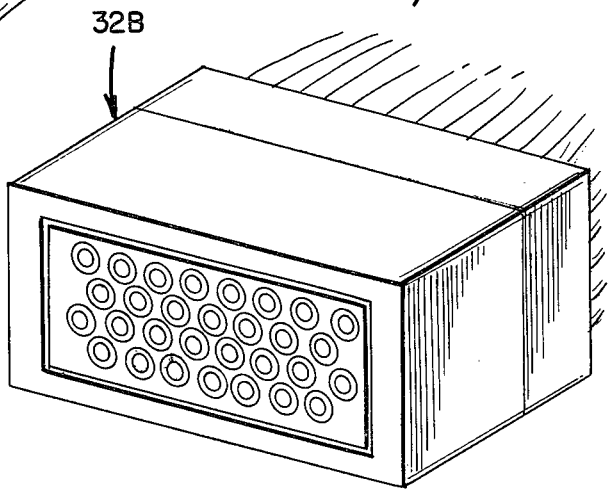
FIG. 5 is an enlarged fragmentary perspective of a rectangular connector containing densely spaced terminals similarly contained in the cylindrical connector of FIG. 4.
Figure 1:
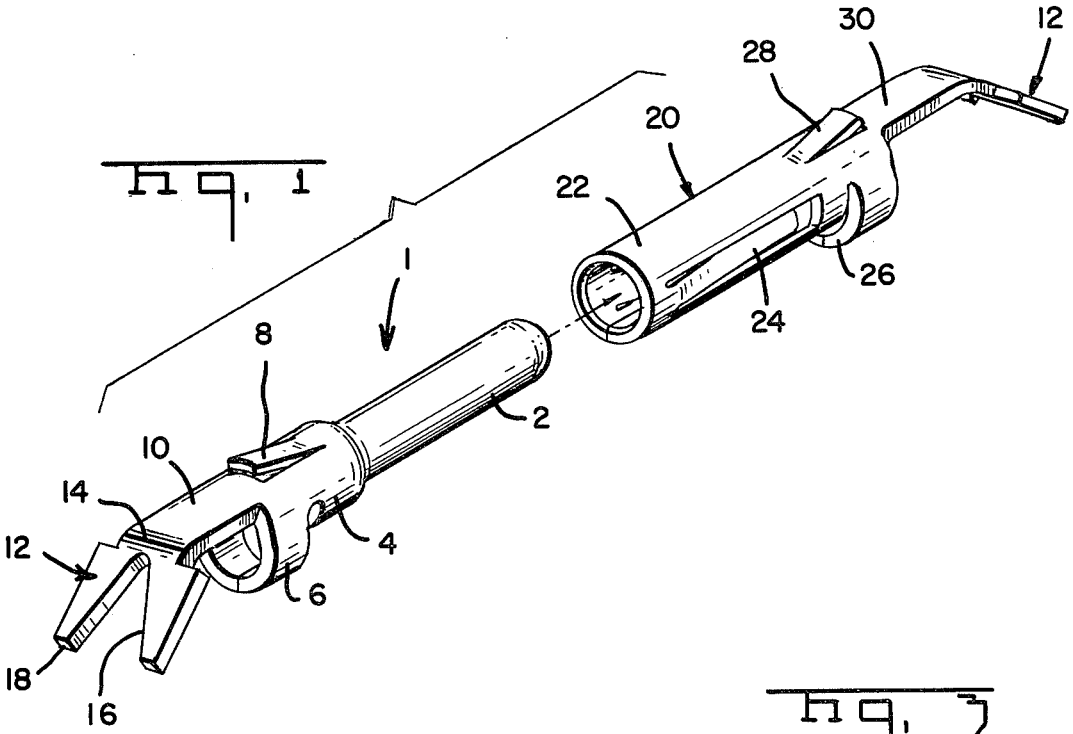
FIG. 1 is an enlarged perspective of a pair of stamped and formed electrical terminals frictionally intermateable by a pin and socket connection.

With more particular reference to FIG. 1, of the drawings, an electrical terminal, illustrated generally at 1, is stamped and formed from a single metal blank according to practices well known. The terminal includes an electrical contact portion 2 in the form of a rolled cylindrical resilient pin. The contact portion 2 is integral with a rolled cylindrical barrel portion 4 of larger, stepped diameter. The barrel 4 is integral with a semicylindrical collar 6 offset laterally of the extended longitudinal axis of the cylindrical contact portion 2. An elongated, finger shaped locking lance 8, joined at one end to the barrel 4, has a free end projecting diagonally outward laterally of the longitudinal axis, and is constructed for resilient deflection toward and away from said axis. The lance 8 is aligned lengthwise generally with a stem portion 10 joined integrally with the collar 6. The stem portion is offset laterally from the aforesaid axis in the same direction as the lance 8. A conductor terminating portion of the terminal is generally indicated at 12, and comprises a flat plate portion, joined by a bendable hinge portion 14 to the remainder of the terminal 1, and projecting initially at an obtuse angle with the remainder of the terminal. The hinge portion may be weakened desirably by scoring or otherwise thinning the metal thickness thereof. The portion 12 includes an open ended slot 16, the open end of which communicates with a free end 18 of the portion 12. The opposite converging sides of the slot 16 also define resilient, conductor gripping jaws constructed for straddling a conductor in a manner to be described in detail.

The terminal 1 is frictionally intermateable with another electrical terminal 20 to establish an electrical connection therewith. The terminal 20, stamped and formed from a single metal blank according to practices which are well known, is formed with a rolled cylindrical socket 22 having at least one elongated resilient spring 24 which projects into the interior of the socket 22 to frictionally engage the pin 2 when the terminals 1 and 20 are intermated. The socket 22 is integral with a semicylindrical collar 26 offset laterally from the extended longitudinal axis of the socket 22. A resilient elongated lance 28, similar to the lance 8, is integral at one end with the terminal 20, and includes a free end which projects diagonally outwardly from the remainder of the terminal, and laterally from the aforesaid axis of the terminal 20. The terminal 20 further includes an elongated stem 30 in lengthwise alignment with the lance 28, and offset laterally in the same direction as the lance 28. The terminal 20 further includes a conductor terminating portion 12 joined integrally with the stem 30. In all respects, the portion 12 of the terminal 20 is similar to the portion 12 of the terminal 1, and the details thereof need not be further described.

Figure 2:
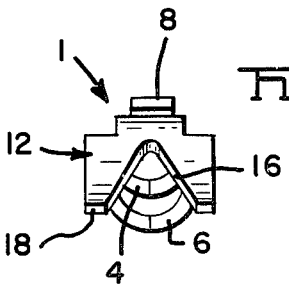
FIG. 2 is an enlarged end elevation of a wire terminating portion of the pin type electrical terminal of FIG. 1.
Figure 3:
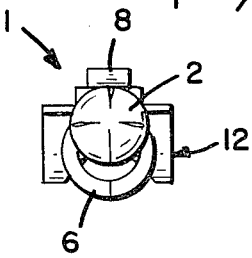
FIG. 3 is an enlarged end elevation of the intermateable pin of an electrical terminal as shown in FIG. 1.

FIGS. 6 through 11 illustrate a specific plug type electrical connector 32 including a housing 34 of generally rigid dielectric material. The housing 34 includes a mating end 36 in which a recess 38 is molded so as to matingly receive a receptacle type connector of a type to be disclosed hereinafter. An opposite, wire receiving end 40 of the housing 34, is provided with a recess 42 having a bottom wall 44 and an intersecting side wall 46 which extends axially of the housing 34. The connector 32 may be cylindrical as shown at 32A in FIG. 3, in which case the recess 42 and the side wall 46 may be cylindrical. The connector 32 may be rectangular as shown in FIG. 2 at 32B, in which case the recess 42 may be rectangular and the side wall 46 may have four intersecting sections arranged in a rectangular configuration.

The housing 34 is provided with a plurality of cavities 48 extending axially from one end 36 to the opposite end 40 of the connector. Each cavity has an enlarged portion 48A adjacent the wall 44. Each cavity has a terminal 1 inserted therein, with the cavity snugly encircling a respective barrel portion 4, and collar 6. With the collar 6 stopped against a shoulder 50, the lance 8 is in registration against the bottom of a slotted recess 52 thereby lockingly retaining the terminal 1 in a respective cavity 48. A suitable blade formed tool may be inserted along the recess 52 to deflect the lance 8 inwardly toward the central axis of the terminal 1, thereby to allow withdrawal of the terminal 1 outwardly of the end 40 of the connector 32.

With the terminal 1 in place within a respective cavity 48 the stem 10 is supported laterally against a side wall of the cavity 48 while the connecting portion 12 projects generally diagonally across the cavity and into the recess 42.

A molded block 54 is slidably mounted within the recess 42. The block 54 is molded from a rigid plastic material and functions as a conductor holder in a manner to be described. The block 54 has a front bearing wall 56 initially in opposed spaced relationship from the bottom wall 44 of the recess 42. A plurality of conductor receiving cavities 58 are provided through the thickness of the block and generally in alignment with respective cavities 48. The block 54 is molded with a plurality of shallow channel supports 60 projecting from the bearing wall 56 toward a respective cavity 48. A transverse end wall 62 is provided at the end of each support 60. Each support 60 further is slidably supported in a groove 64 laterally opening into a respective cavity 48. Each cavity 58 is provided with an enlarged counterbore 66. The block 54 is covered by a thin, molded membrane or web 68 molded from a sealing material. The web 68 is provided with an outer lip 70 which resiliently compresses against the interface between the block 56 and the recess 42 of the housing 32. The web 68 is provided with stretchable, apertured frustoconical portions 72 in alignment with respective counterbores 66.

Figure 6:
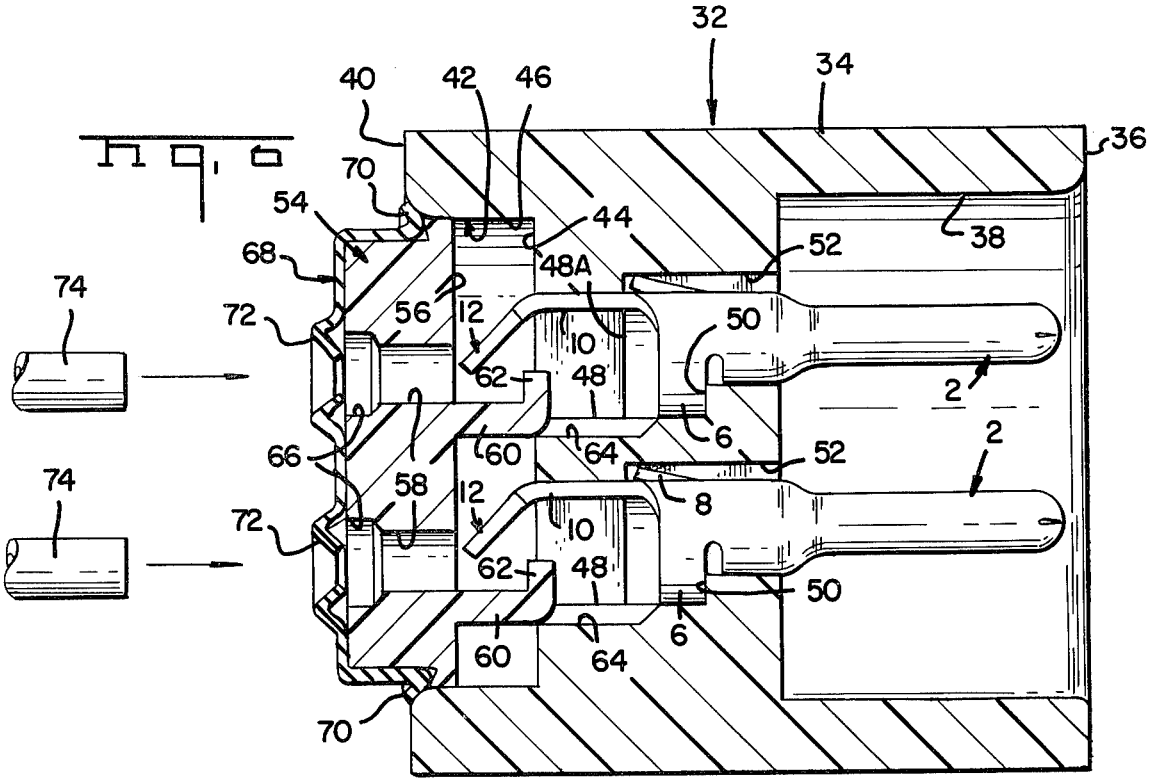
FIG. 6 is an enlarged elevation in section of a plug type electrical connector according to the present invention incorporating electrical terminals as illustrated in FIGS. 1-3.
Figure 7:
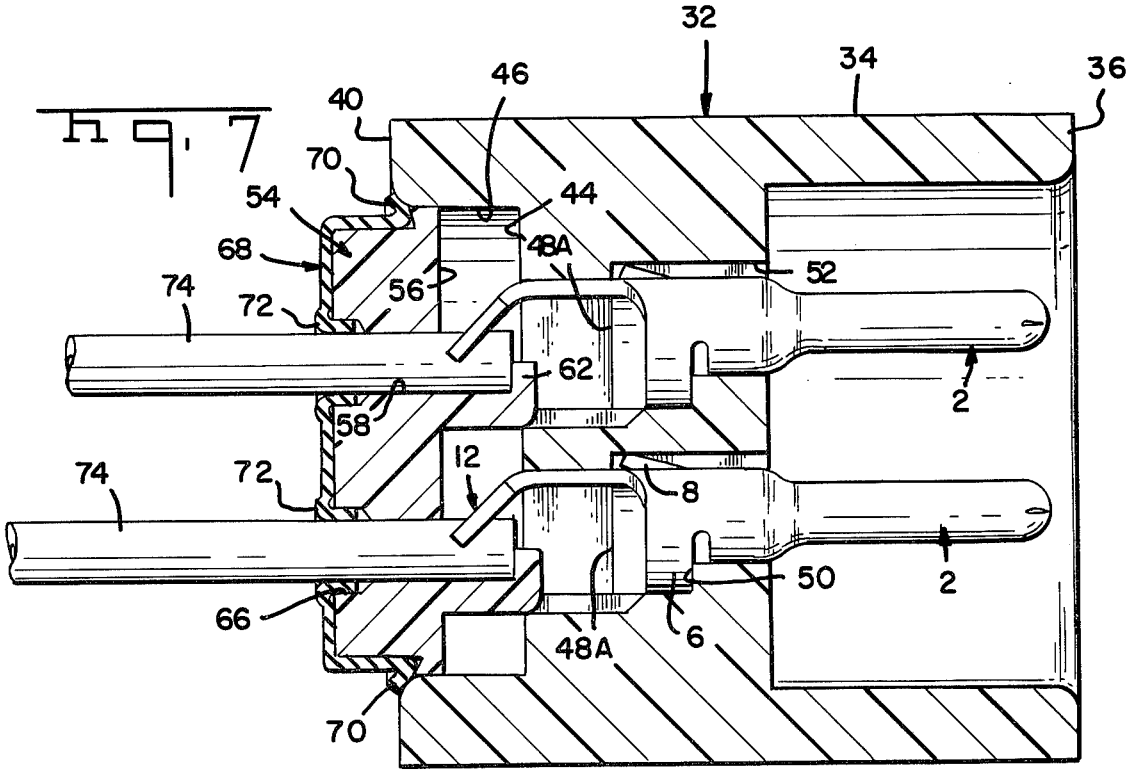
FIG. 7 is a view similar to FIG. 6 illustrating initial positioning of insulated wires on a conductor holder.
Figure 10:
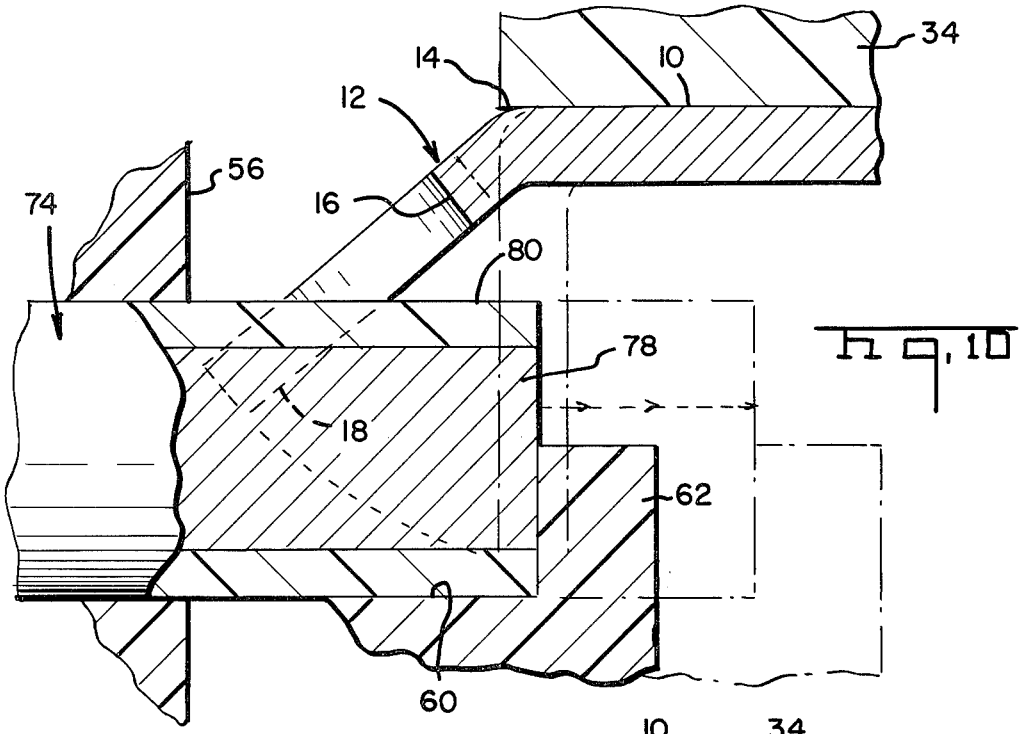
FIGS. 10, 11 and 12 are diagrammatic views illustrating a conductor and a wire terminating portion of a terminal.
Figure 11:
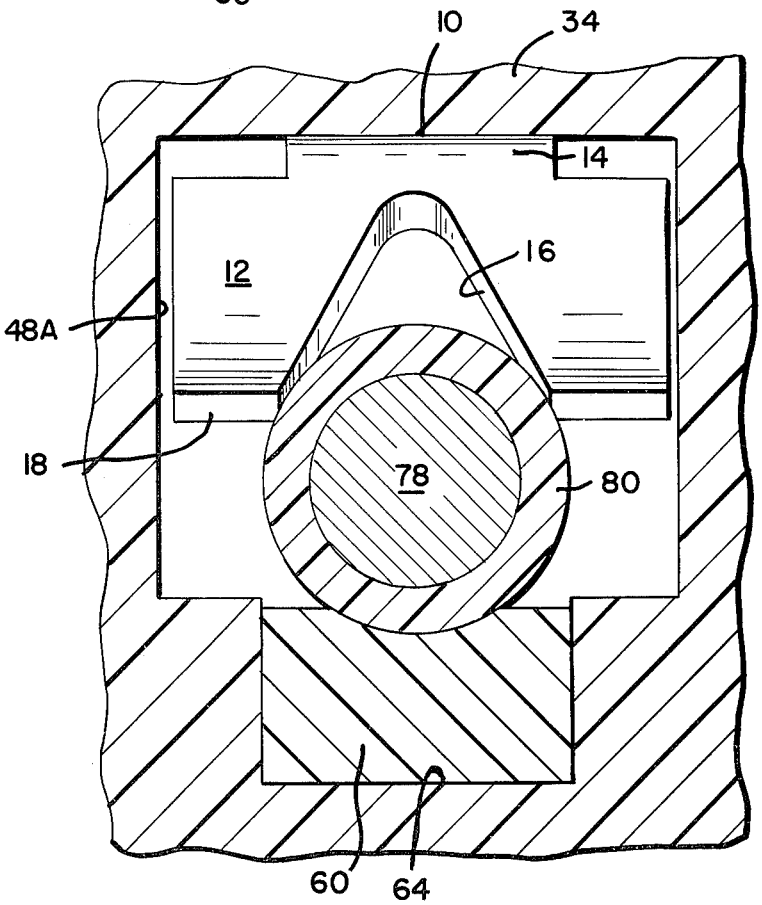
Figure 12:
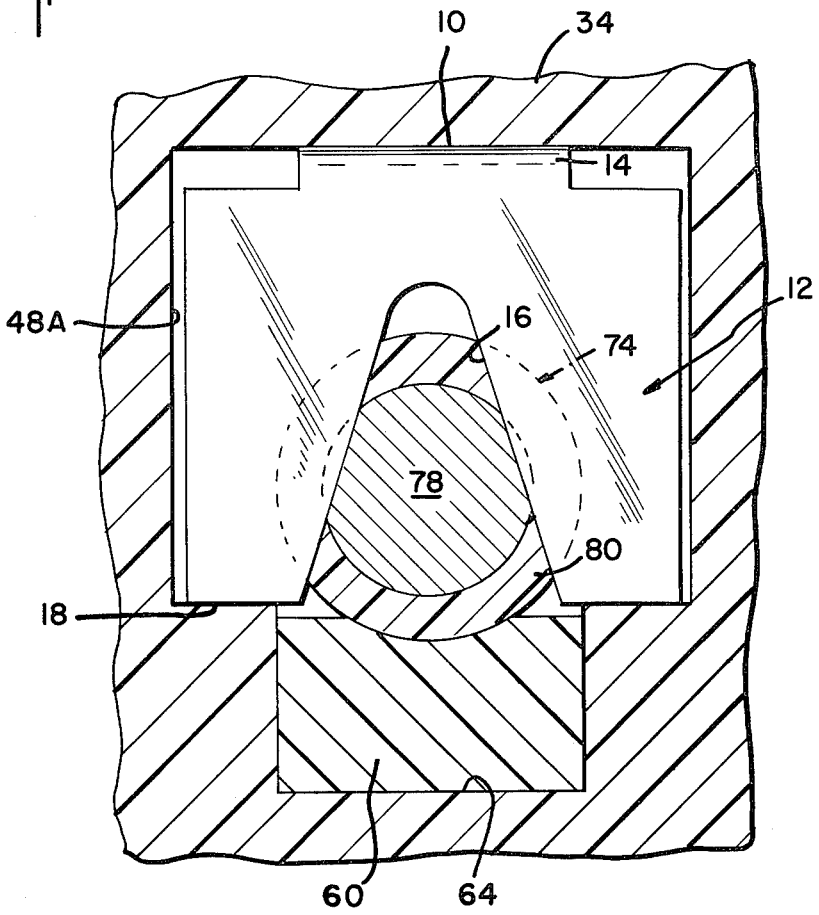

As shown with reference to FIGS. 6 and 7, electrical conductors 74 are inserted endwise and lengthwise through respective apertured, frustoconical portions 72 of the web 68 and along respective bores 58 until the end of the conductors 74 impinge against the walls 62. Each frustoconical portion 72 snugly and sealingly encircles a conductor 74 and is caused to stretch and extend toward and into a counterbore 66. As shown in conjunction with FIGS. 7, 8, and 11, the block 54 serves to support and position each conductor 74 along a support 60 and through the slot 16 of a respective diagonally projecting plate portion 12, with the jaws of the respective slot 16 initially straddling the conductor. As shown in FIGS. 10–12, each conductor 74 includes a central wire 78 encircled by a sheath of insulation 80.

Figure 8:
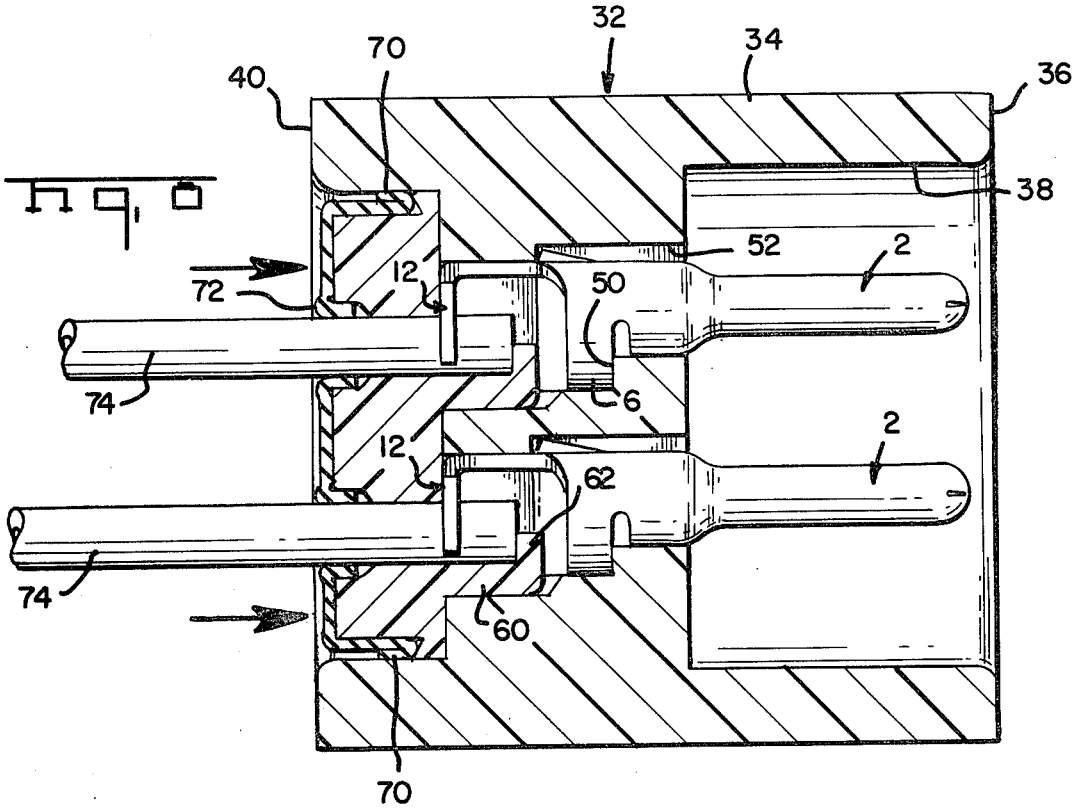
FIG. 8 is a view similar to FIG. 7 illustrating mass termination of the conductors by the terminals of the illustrated plug connector.

As shown in FIGS. 7, 8, and 10 when all the conductors 74 are in place on the holder, the holder is displaced slidably toward the housing. The bearing wall 56 engages the free end 18 of each plate portion 12 and forces against each plate portion, pivoting the plate portion from its diagonal orientation, forceably into and against a straddled conductor 74, and then into an orientation transversely of the straddled conductor and of the remainder of the respective terminal. Thereby the jaws defined by the sides of the slot 16 become wedged in straddled gripped connection with the conductor as shown in FIG. 12. The insulation 80 is sliced through by the jaws and then scraped aside by the pivoting action of the respective plate 12, so that the jaws indent partially into the wire 78 to make an electrical connection therewith. It should be understood that noninsulated conductors are also capable of termination, as well as insulated conductors which have been previously stripped of their insulation to expose the internal conductors. The holder 54 seats against the wall 44, and the plate portions 12 fully enter the enlarged cavity portions 48A.

Pivoting of each plate portion 12 occurs by permanently bending the hinge portion 14. As pivoting of the plate portion occurs, the plate portion becomes progressively transverse to both the housing 34 and the straddled conductor 74. The greatest compression force, exerted by the jaws against the conductor, occurs when the plate is transversely of both the conductor axis and of the direction of conductor insertion, thereby producing a "toggle action". The angular direction of pivoting follows the direction of conductor insertion, and thereby assists rather than impedes conductor insertion. Slidable displacement of the channel supports along the grooves 64 occurs without undue frictional resistance, since the toggle action is delayed until the holder is nearly seated against the wall 44.

The described mass termination procedure involves a limited number of motions and operations, and thereby is suited for automation. Since the toggle action is confined within the restricted width cavities, and since no transverse motion of the conductors is required during the termination operation, the conductors may be densely spaced within the connector.

Sealing of the connector is accomplished by the web 70. The conductors 76 stretch the apertured frustoconical portions 74 causing the same to roll into the counterbores 68. The lip 72 is doubled back on itself by a rolling action as the holder 56 is slidably displaced into the recess 42.

Figure 9:
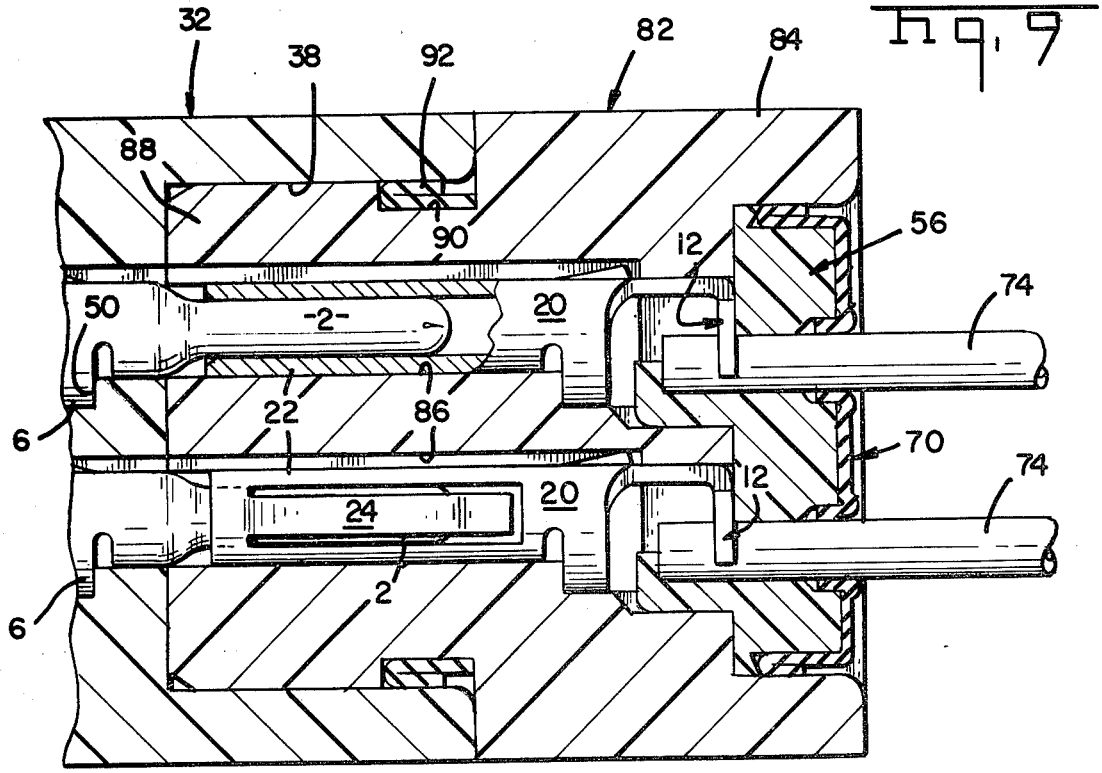
FIG. 9 is an enlarged elevation in section of the plug connector illustrated in FIG. 8 intermated electrically with a receptacle connector in which socket type electrical terminals are mass terminated to corresponding conductors.

FIG. 9 illustrates the plug connector 32 intermated with a receptacle type connector 82 of which a rigid dielectric housing 84 is provided with cavities 86 receiving respective sockets 20 therein. The housing 84 is provided with the same conductor holder 54 and sealing web 68 of the plug connector 32. Additional insulated conductors 74 are illustrated which are mass terminated by plate portions 12 of the sockets 20 in a manner similarly as described in conjunction with the plug connector 32. A mating end 88 of the housing 84 is inserted into the recess 38, simultaneously as the pins 2 are inserted along the sockets 22, and are frictionally engaged by the spring fingers 24. An annular recess 90 encircling the receptacle mating end 88 is provided therein with a sealing member 92 which is rolled back on itself and which seals the interface between the mating ends of the receptacle connector 82 and the plug connector 32.

Although preferred embodiments of the present invention have been described in detail, other modifications and embodiments thereof which would be apparent to one having ordinary skill in the art are intended to be covered by the spirit and scope of the appended claims.

What is claimed is:

1. An electrical connector, comprising:

a housing having a first end and a wire receiving second end, one or more cavities extending through said housing from said first end to said second end, an electrical terminal in each said cavity having an electrical contact portion projecting toward said housing first end, and a conductor connecting portion projecting toward said housing second end, each said connecting portion being pivotally joined to the remainder of a respective said terminal and being provided with a slot, the opposite sides of which define conductor gripping jaws constructed for straddling a conductor which extends both into said housing second end and along a respective said cavity, each said connecting portion being pivotable to a position transversely of the remainder of a respective said terminal to wedge forcefully said jaws into straddled gripped connection with a respective said conductor, conductor support means mounted to said housing for supporting said conductors laterally of their lengths as said conductors are straddled by said jaws and as said connecting portions are pivoted to forcefully wedge said jaws into straddled gripped connection with said conductors, and a web of resilient material radially compressibly encircling said conductors and compressibly sealing the interface of said housing and said conductor support means.

2. An electrical connector, comprising:

a housing having a first end and a wire receiving second end, one or more cavities extending through said housing from said first end to said second end, an electrical terminal in each said cavity having an electrical contact portion projecting toward said housing first end, and a conductor connecting portion projecting toward said housing second end, each said connecting portion being pivotally joined to the remainder of a respective said terminal and being provided with a slot, the opposite sides of which define conductor gripping jaws constructed for straddling a conductor which extends both into said housing second end and along a respective said cavity, each said connecting portion being pivotable to a position transversely of the remainder of a respective said terminal to wedge forcefully said jaws into straddled gripped connection with a respective said conductor, conductor support means mounted to said housing for supporting said conductors laterally of their lengths as said conductors are straddled by said jaws and as said connecting portions are pivoted to wedge forcefully said jaws into straddled gripped connection with said conductors, and portions of said conductor support means are slidably supported against walls of respective said cavities during pivoting of said connecting portions to connect the jaws thereof to respective conductors supported on said conductor support means.

3. An electrical connector, comprising:

a housing having a first end and a wire receiving second end, one or more cavities extending through said housing from said first end to said second end, an electrical terminal in each said cavity having an electrical contact portion projecting toward said housing first end, and a conductor connecting portion projecting toward said housing second end, each said connecting portion being pivotally joined to the remainder of a respective said terminal and being provided with a slot, the opposite sides of which define conductor gripping jaws constructed to straddle a conductor which extends both into said housing second end and along a respective said cavity, each said connecting portion being pivotable to a position transversely of the remainder of a respective said terminal to wedge forcefully said jaws into straddled gripped connection with a respective said conductor, and conductor support means for supporting thereon said conductors, said conductor support means being mounted to said housing for displacement toward said housing second end to engage and pivot said connecting portions to connect the jaws thereof to respective said conductors.

4. The structure as recited in claim 3, and further including: a web of resiliently deformable material compressibly encircling said conductors and compressibly sealing the interface of said housing and said conductor support means.

5. The structure as recited in claim 3, wherein portions of said conductor support means are slidably supported against walls of respective said cavities upon pivoting said connecting portions to connect the jaws thereof to respective conductors supported on said conductor support means.

6. An electrical connector, comprising:

a housing having a first end and a wire receiving second end, one or more cavities extending through said housing from said first end to said second end, an electrical terminal in each said cavity having an electrical contact portion projecting toward said housing first end, and a conductor connecting portion projecting toward said housing second end, each said connection portion being pivotally joined to the remainder of a respective said terminal and being provided with a slot, the opposite sides of which define conductor gripping jaws constructed for straddling a conductor which extends both into said housing second end and along a respective said cavity, and means mounted to said housing for supporting said conductors and for moving said conductors in a direction of conductor insertion toward respective terminals, each said connecting portion being pivotable in an angular direction following the direction of conductor insertion and to a position transversely of the remainder of a respective said terminal to wedge forcefully said jaws into straddled gripped connection with a respective said conductor.

7. The structure as recited in claims 2, 3 or 6, wherein, each said connecting portion is integrally joined by a bendable hinge portion to the remainder of a respective said terminal, and said hinge portion is permanently bent upon pivoting said connecting portion with respect to the remainder of a respective said terminal.

* * * * *